US008910838B2

(12) United States Patent
Palmer et al.

(10) Patent No.: US 8,910,838 B2
(45) Date of Patent: Dec. 16, 2014

(54) LAP DESK

(76) Inventors: Benjamin M. Palmer, Seattle, WA (US); Cathy W. Palmer, Lake Stevens, WA (US)

( * ) Notice: Subject to any disclaimer, the term of this patent is extended or adjusted under 35 U.S.C. 154(b) by 152 days.

(21) Appl. No.: 13/366,158

(22) Filed: Feb. 3, 2012

(65) Prior Publication Data

US 2012/0199622 A1 Aug. 9, 2012

Related U.S. Application Data

(60) Provisional application No. 61/439,248, filed on Feb. 3, 2011.

(51) Int. Cl.

| | |
|---|---|
| ***A47B 23/02*** | (2006.01) |
| ***A47B 23/00*** | (2006.01) |
| ***A47B 23/04*** | (2006.01) |
| *A45F 3/04* | (2006.01) |

(52) U.S. Cl.

CPC ..... *A47B 23/002* (2013.01); *A45F 3/04* (2013.01); *A47B 23/043* (2013.01)

USPC ..... 224/153; 224/627; 108/43

(58) Field of Classification Search

USPC ..... 224/153, 575, 627, 275, 484, 485; 108/43, 44; D6/406.3; 248/454–456

See application file for complete search history.

(56) References Cited

U.S. PATENT DOCUMENTS

| | | | | | |
|---|---|---|---|---|---|
| D132,098 | S | * | 4/1942 | Corbett | D6/420 |
| 3,773,154 | A | * | 11/1973 | Mitchell | 190/11 |
| 4,460,146 | A | * | 7/1984 | Raggiotti | 248/456 |
| 4,700,634 | A | * | 10/1987 | Mills et al. | 108/43 |
| 5,439,153 | A | * | 8/1995 | Murdoch et al. | 224/658 |
| 5,460,102 | A | * | 10/1995 | Pasmanick | 108/43 |
| 5,680,973 | A | * | 10/1997 | Vulpitta et al. | 224/153 |
| 5,732,849 | A | * | 3/1998 | Brooks | 220/603 |
| 5,975,392 | A | * | 11/1999 | Miller et al. | 224/651 |
| 6,050,200 | A | * | 4/2000 | Sullins et al. | 108/43 |
| 2003/0029985 | A1 | * | 2/2003 | Zeller et al. | 248/461 |
| 2005/0211138 | A1 | * | 9/2005 | Gupta | 108/43 |

* cited by examiner

*Primary Examiner* — Brian D Nash
*Assistant Examiner* — Corey Skurdal
(74) *Attorney, Agent, or Firm* — Seed IP Law Group PLLC

(57) ABSTRACT

A lap desk having a highly adjustable surface to hold a variety of electronics and media, including tablet and handheld devices, laptops, portable gaming and electronic devices, writing pads, books and magazines for use while sitting, laying down, reclining, and standing, including multiple angle adjustments between 0 and 90 degrees, a foam base for comfort, and storage and pocket areas for devices, cables, and other accessories. The lap desk can include a removable or permanent travel cover that holds the entire unit and any stored equipment, and it can include a detachable stuffed animal to make it more child friendly.

11 Claims, 18 Drawing Sheets

LAP DESK

BACKGROUND

1. Technical Field

The present disclosure is directed to structures that support documents, equipment, books, working tools, and other objects on the lap of a user and, more particularly, to a portable device that provides adjustability in the presentation of supported articles, concealed storage, portability, and enhanced comfort to users.

2. Description of the Related Art

Table stands, lecterns, music stands, and similar devices have long existed to hold media and other objects. Some have included various ways of angling the media to a user's desired preference. These units have a limitation of only being able to be used while a user is seated or standing at a desk or table.

Lap desks have long existed to hold media and other objects. These include breakfast trays, book frames, writing desks, wedges, bean bag pillows, etc. These units have been designed to be used either on or above users' laps. Most lap desks only offer a single flat or angled surface to support objects, such as books, documents, and the like. Attempting to adjust the angle on a lap desk today is a cumbersome and often times impossible task because of the lap desk design.

BRIEF SUMMARY

The present disclosure provides a lap desk that combines ease of angle adjustment with the comfort and portability not found in current lap desks, creating a unique all-in-one solution.

In accordance with one aspect of the present disclosure, a support device is provided that includes an adjustable smooth flat surface with a stop member for media and objects to rest on for viewing and other use by a user. The surface includes an integrated angle-adjuster that folds up and out of the smooth flat surface to create a prop for media or objects to rest against. The angle adjustment can be implemented in a simple structure that provides a series of rows to give users a variety of choices and flexibility in finding the desired angle for reclined, sitting, laying, or standing use.

In accordance with one aspect of the present disclosure, the stop is a lip at the front to act as a fulcrum point as well as a stop for supported objects. Because the support surface only has one lip or stop along a single edge of the lap desk, supported articles can be longer or wider than the size of the lap desk, offering nearly endless possibilities for what can be used on the lap desk.

A foam base is provided that is cut into a wedge or flat shape and then into two pieces and upholstered to define an expandable enclosure, providing a full-length two-sided foam protected enclosed storage area to store electronic tablet devices and other media. The storage area can be concealed by including an additional storage pocket on the front or rear of the base. It can also be concealed using a flap with a locking closure mechanism (magnet, button, hook, snap, etc.). This smaller storage area or pocket can be used to hold a permanent or removable product travel cover.

The foam base can include integrated magnets to adapt the base into new applications. As an example custom made stuffed animal toys with receiver magnets can snap onto the foam base and create a child friendly tablet stand, lap desk, book easel or any combination thereof.

In accordance with another aspect of the present disclosure, a device to support objects on a user's lap is provided, the device includes a base having a cushioned bottom surface and a top having a planar surface and mounted to the base. The top includes an articulated bi-fold support stand to support objects at a selected angle relative to the planar surface on the top.

In accordance with another aspect of the present disclosure, the base includes an expandable storage compartment. Ideally an opening is formed on one side of the base to provide access to the storage pocket. In addition, a pouch is formed on the exterior of the base on another sidewall of the base.

In accordance with another aspect of the present disclosure, the articulated support stand includes a first panel and a second panel, the first panel having a first edge attached to the top with a hinge for pivotal movement, and an opposing second edge attached with a hinge to a first edge of the second panel. Ideally, the top includes a recessed area sized and shaped to receive the first and second panels in a coplanar relationship with each other and with the planar top surface.

In accordance with still yet another aspect of the present disclosure, a plurality of stops are formed in the recess that are structured to receive a second edge of the second panel and hold the stand at the selected angle as determined by the position of a selected stop relative to the first edge of the first panel.

In accordance with yet a further aspect of the present disclosure, a lip is formed at or adjacent to a proximal edge of the top, the lip being sized and shaped to retain objects on the top when the objects are supported by the stand or when the top is at an orientation that would cause objects to slide off the top.

In accordance with still yet another aspect of the present disclosure, a cover is provided that is sized and shaped to receive the device and enclose the device therein. Ideally the cover is formed of fabric material, is attached to the base, and is structured to be stored in the pouch. Preferably, the cover includes at least one strap that is structured to be used as a handle or shoulder strap, and two straps can be provided so that the stored portable lap desk and cover can be worn as a backpack.

In accordance with yet another aspect of the present disclosure, a stuffed animal is provided that is structured to be attached to the base or the top or both the base and the top.

In accordance with a further aspect of the present disclosure, a portable lap desk is provided that includes a base formed of cushioned material and having an internal storage compartment formed in the cushioned material that is accessible via at least one opening in the cushioned material; a rigid planar top attached to the base, the top having a plurality of stops formed in a recess on a working surface of the top; and a bi-fold stand attached by a hinge mechanism to the top and configured to cooperate with the plurality of stops to be deployed at a selected angle relative to the working surface of the top.

In accordance with yet a further aspect of the present disclosure, the articulated support stand includes a first panel and a second panel, with the first panel having a first edge attached to the top with a hinge for pivotal movement and an opposing second edge attached with a hinge to a first edge of the second panel. Preferably the recess in the working surface of the top is sized and shaped to receive the first and second panels in a coplanar relationship with each other and with the planar top surface.

In accordance with yet a further aspect of the present disclosure, the plurality of stops are formed in the recess and are structured to receive a second edge of the second panel and hold the stand at the selected angle as determined by the position of a selected stop relative to the first edge of the first panel.

In accordance with yet a further aspect of the present disclosure, a lip is formed at or adjacent to a proximal edge of the top, the lip sized and shaped to retain objects on the top when the objects are supported by the stand or when the top is at an orientation that objects could slide off the working surface of the top at the proximal edge of the top.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the following drawings, wherein:

FIG. 18 illustrates a molded plastic contour that creates angles for the prop stand to rest on.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures or components or both associated with supports, lecterns, desks, and other similar devices, have not been shown or described in order to avoid unnecessarily obscuring descriptions of the embodiments.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one embodiment" or "an embodiment" means that a particular feature, structure, or characteristic described in connection with the embodiment is included in at least one embodiment. Thus, the appearance of the phrases "in one embodiment" or "in an embodiment" in various places throughout the specification are not necessarily all referring to the same embodiment. Furthermore, the particular features, structures, or characteristics may be combined in any suitable manner in one or more embodiments.

Figure 1:
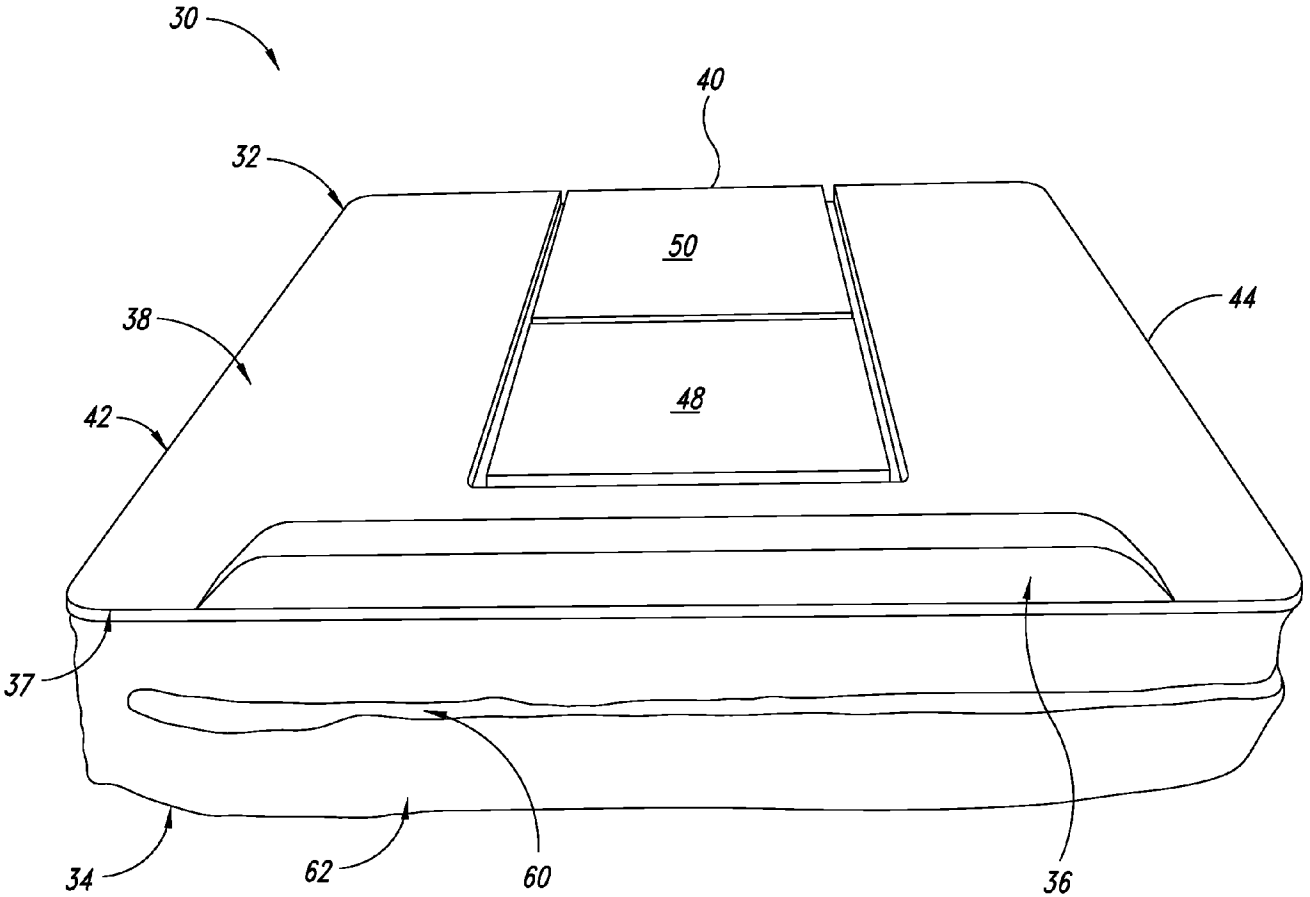
FIG. 1 is a front isometric view of a lap desk formed in accordance with a first embodiment of the present disclosure having a front internal storage compartment and rear storage pocket with detachable cover.

The present disclosure is directed to a lap desk as shown in the accompanying figures. More particularly, FIGS. 1-3 show a lap desk 30 formed in accordance with one embodiment of the present disclosure to include a top 32 mounted on a base or cushioned bottom 34.

The top 32 has a front lip 36 centered along a front edge 37 of the top 32 that, ideally, does not span the entire width of the top 32. The lip 36 is sized and shaped to provide a supporting shoulder for objects that are placed on the exposed planar surface 38 of the top 32. The rear edge 40 and first and second opposing side edges 42, 44 of the top 32 have no stops, ridges, or other projections extending out of the planar surface 38, allowing a user to place objects of almost any size on the top 32 without interference from other structures.

In one embodiment, the top 32 can be removed from the base or cushioned bottom 34. For example, the top 32 can be made of plastic and can be mounted on the base 34 so that it is removable. The top can be attached to the foam base through a number of means that allow it to be removed, such as hook-and-loop fasteners, metal or plastic fasteners, snaps, zippers, straps, and the like. One example would be the use of embedded magnets inside the top 32 and corresponding magnets in the foam base 34 that, when aligned for magnetic attraction, hold the top in place by the force of magnetic attraction alone or in combination with a snap. Another method is to use legs or posts on the base 34 that lock into a slot on the plastic top 32. When the top is removed and the legs deployed, the top 32 becomes a desk stand without the bulk of the foam base 34. The top 32 would include non-slip feet or surfaces on its base to prevent it from sliding on a supporting surface when the legs are not used.

Figure 2:
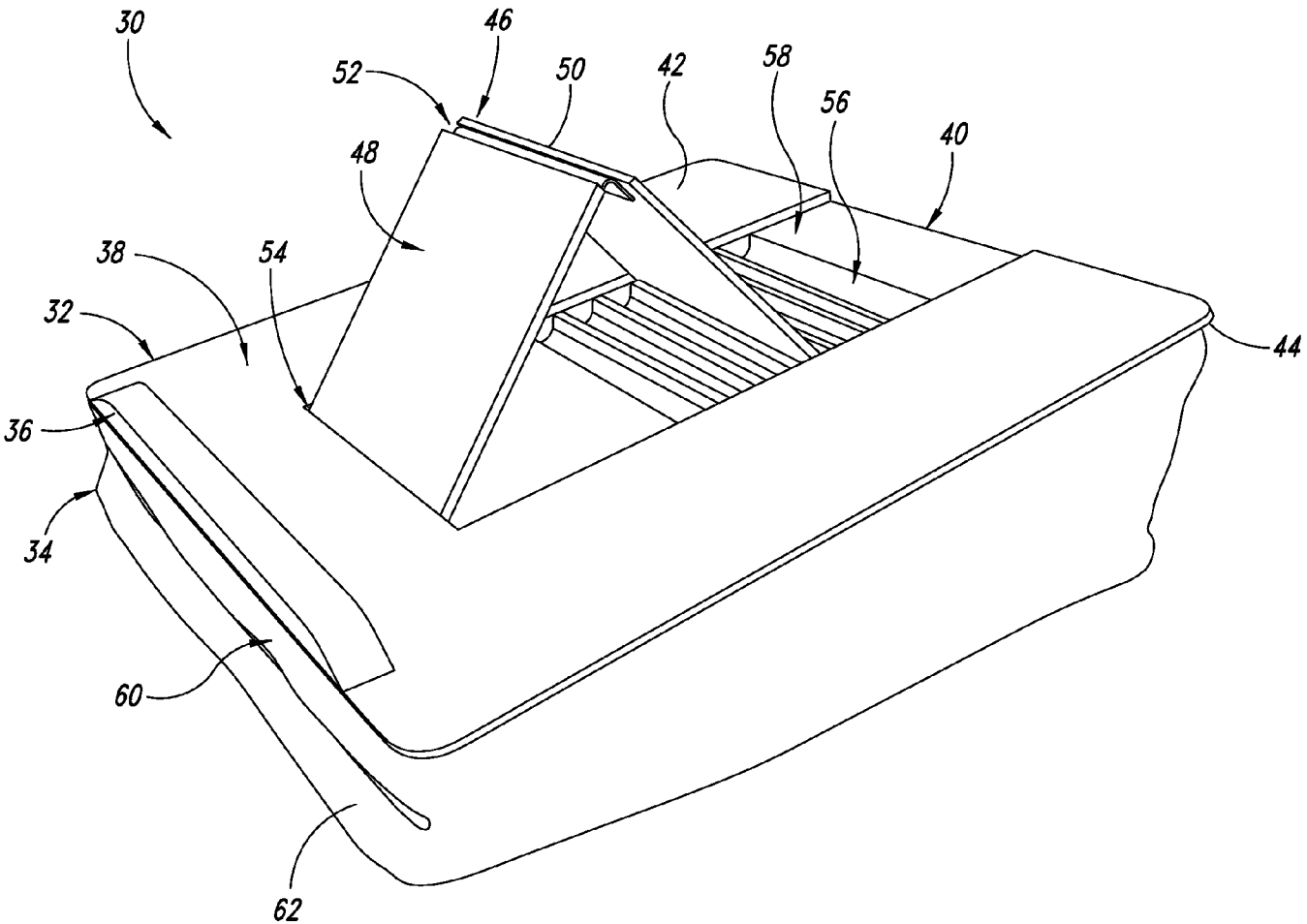
FIG. 2 is an isometric side view showing the lap desk of FIG. 1 with a support surface in a deployed configuration.
Figure 3:
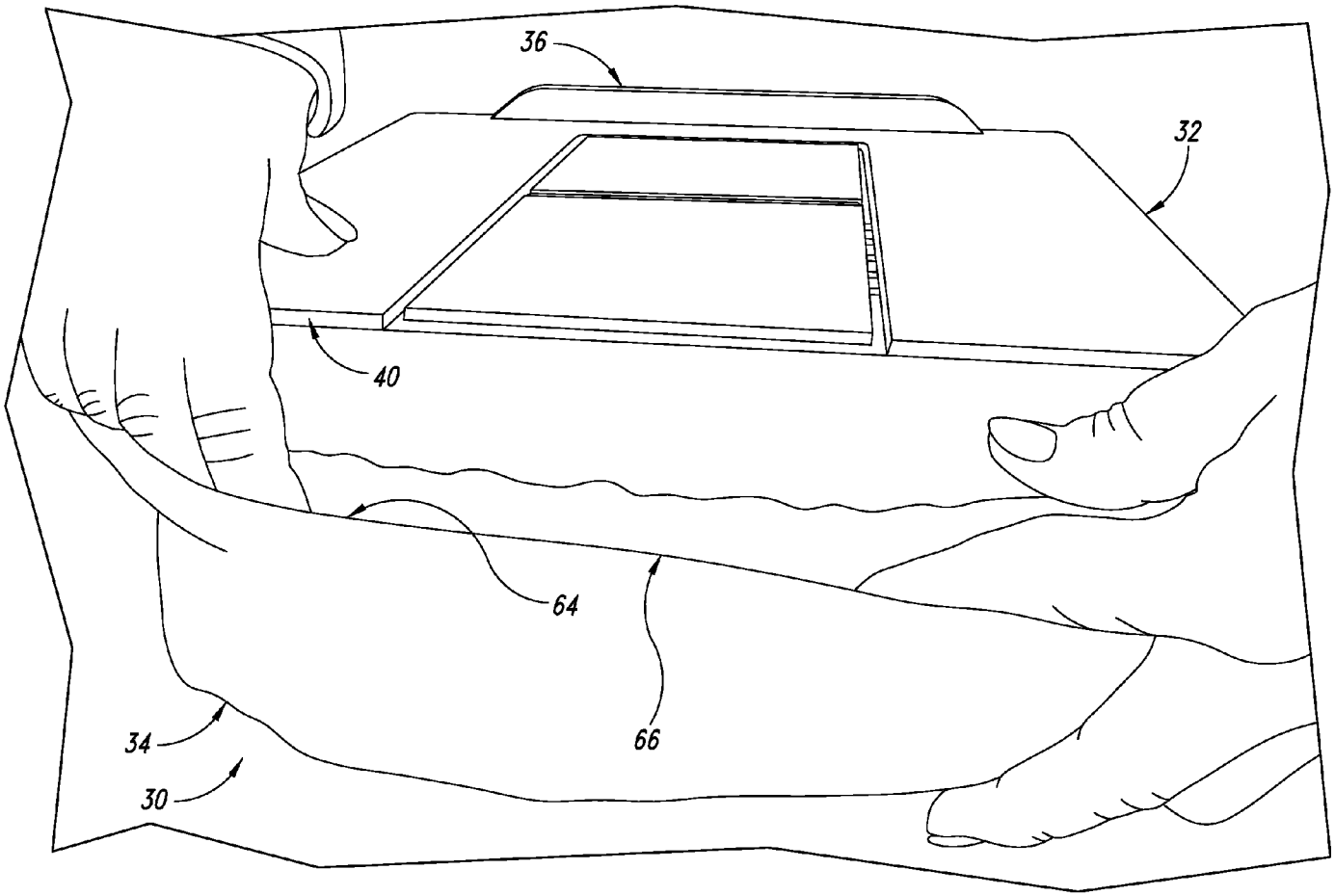
FIG. 3 is a front isometric view of a lap desk with storage pocket formed in accordance with another aspect of the present disclosure.

Formed in the top 32 is a bi-fold support stand 46 that extends out of the surface of the top to support objects resting on the top 32 at a selected angle towards a user, as shown in FIG. 2. More particularly, the bi-fold support 46 is formed of two articulated panels 48, 50 coupled at a transverse center hinge point 52, preferably by a piano hinge, and mounted for pivotal movement to the top 32 at the forward edge 54 of the forward most panel 48. A plurality of transverse stop members 56 are formed in a recess 58 in the top 32 that retain the rearward most panel 50 at selected upright angled positions relative to the top 32. The recess 58 is sized and shaped to allow the panels 48, 50 to unfold and lay flat in the recess 58 so as to be substantially planar with the surface 38 of the top 32.

Also shown is a transverse opening 60 on a front portion 62 of the cushioned bottom 34 that provides access to an expandable internal storage compartment. Ideally, the internal storage compartment is sized slightly smaller than the outside dimensions of the desk 30 and is lined with the material of the exterior of the cushioned bottom 34. The opening 60 is ideally not closed, although a flap or zipper or other closing mechanism can be provided if desired.

Shown in FIG. 3 is a rear pocket 64 in the form of a pouch having an open top 66 that extends almost the entire width of the desk 30. Articles such as a removable cover or handle can be stored in the pocket 64.

Figure 4:
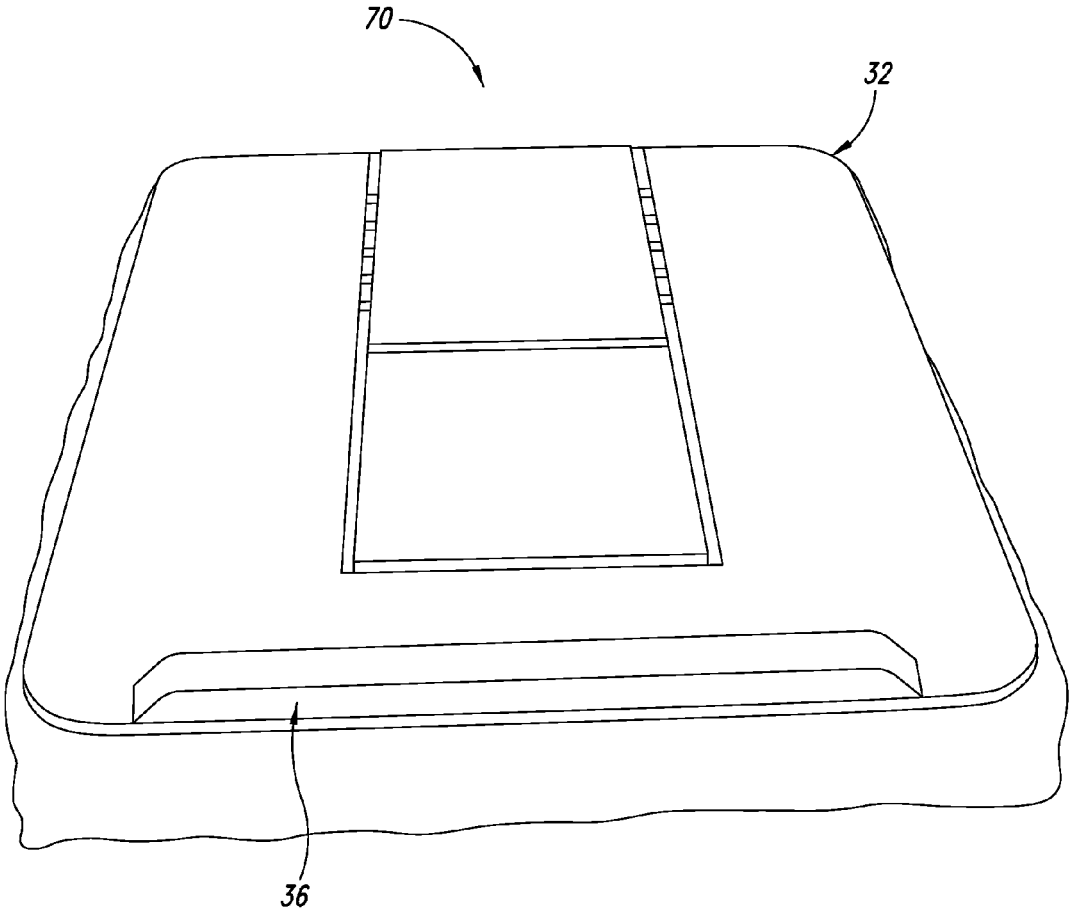
FIG. 4 is a front isometric view of a lap desk formed in accordance with a further embodiment of the present disclosure having a rear storage pocket, rear internal storage compartment, and detachable cover.
Figure 5:
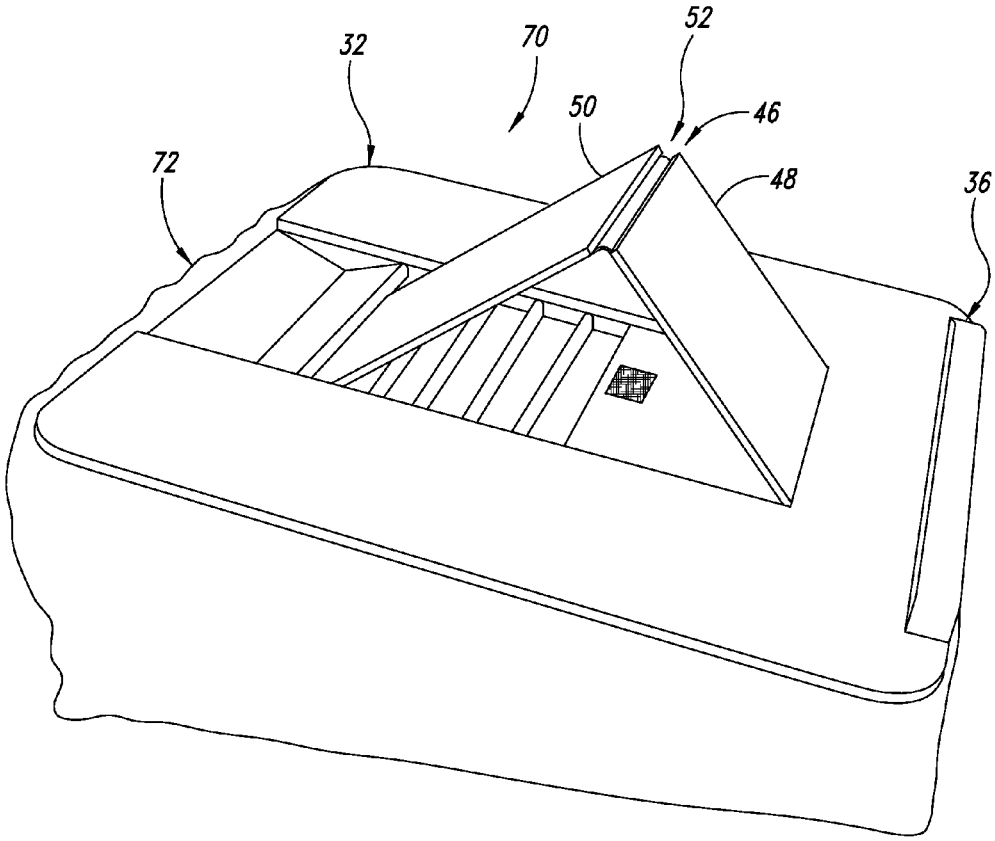
FIG. 5 is an isometric side view of the lap desk of FIG. 4.
Figure 6:
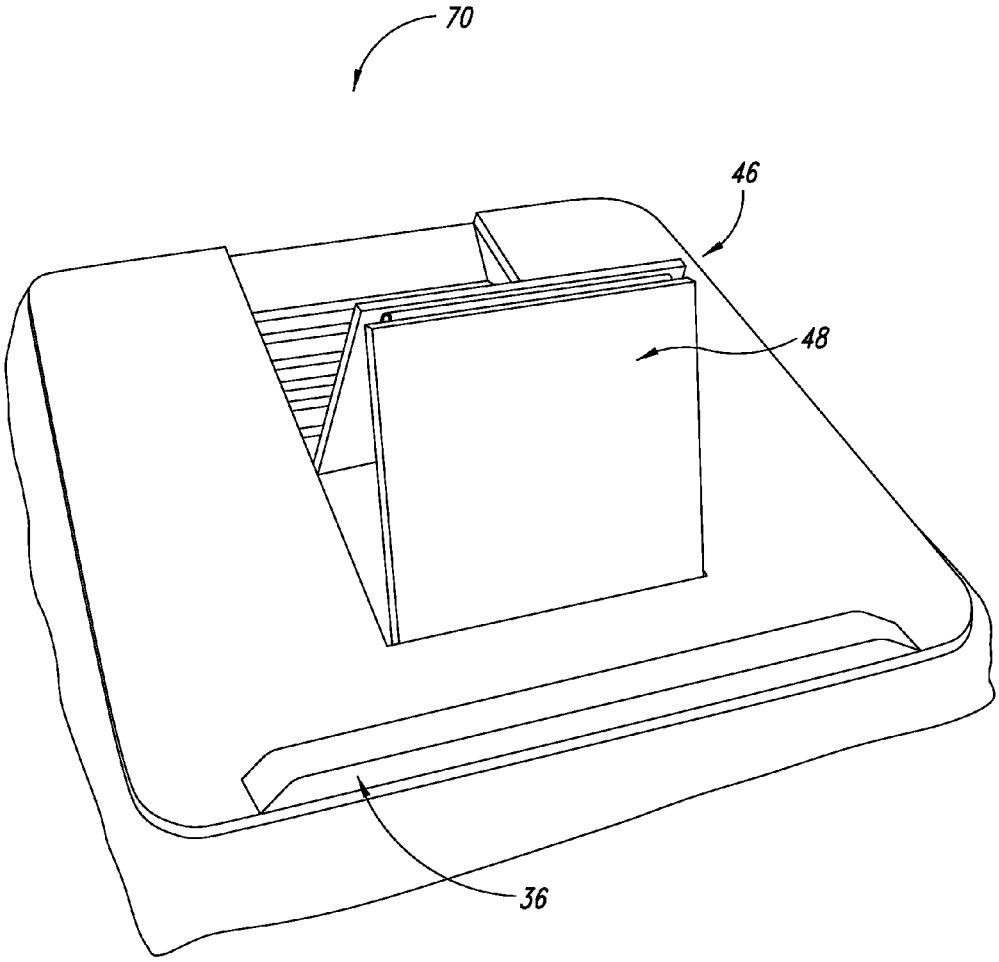
FIG. 6 is an isometric side view of the lap desk of FIG. 4 showing the opposite side of the view of FIG. 4.

Referring next to FIGS. 4-6, shown therein is a lap desk 70 formed in accordance with a further embodiment of the present disclosure having a rear storage pocket 72, rear internal storage compartment 74, and detachable cover 76.

Other elements of the desk 70 similar to those of the desk 30 described above with respect to FIGS. 1-3 are similarly numbered.

Figure 7:
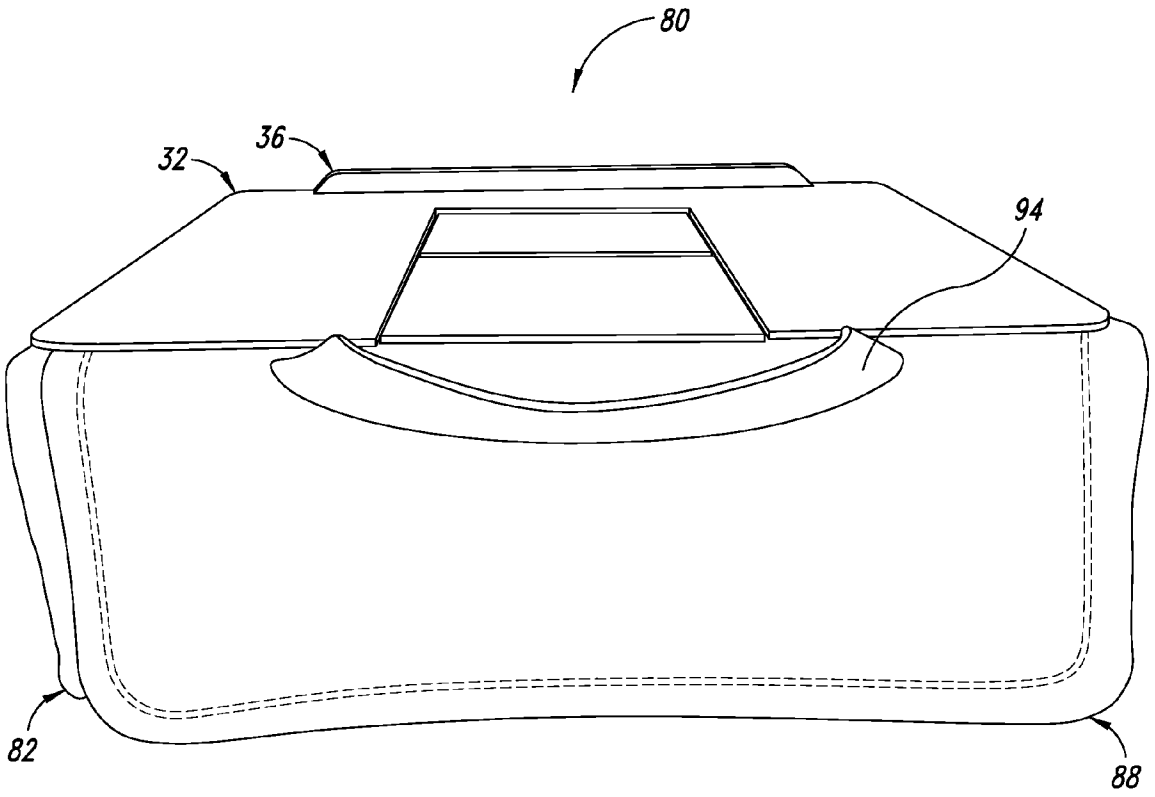
FIG. 7 is a front plan view of yet another embodiment of a lap desk formed in accordance with the present disclosure having a rear storage compartment with magnetically closed flap.
Figure 8:
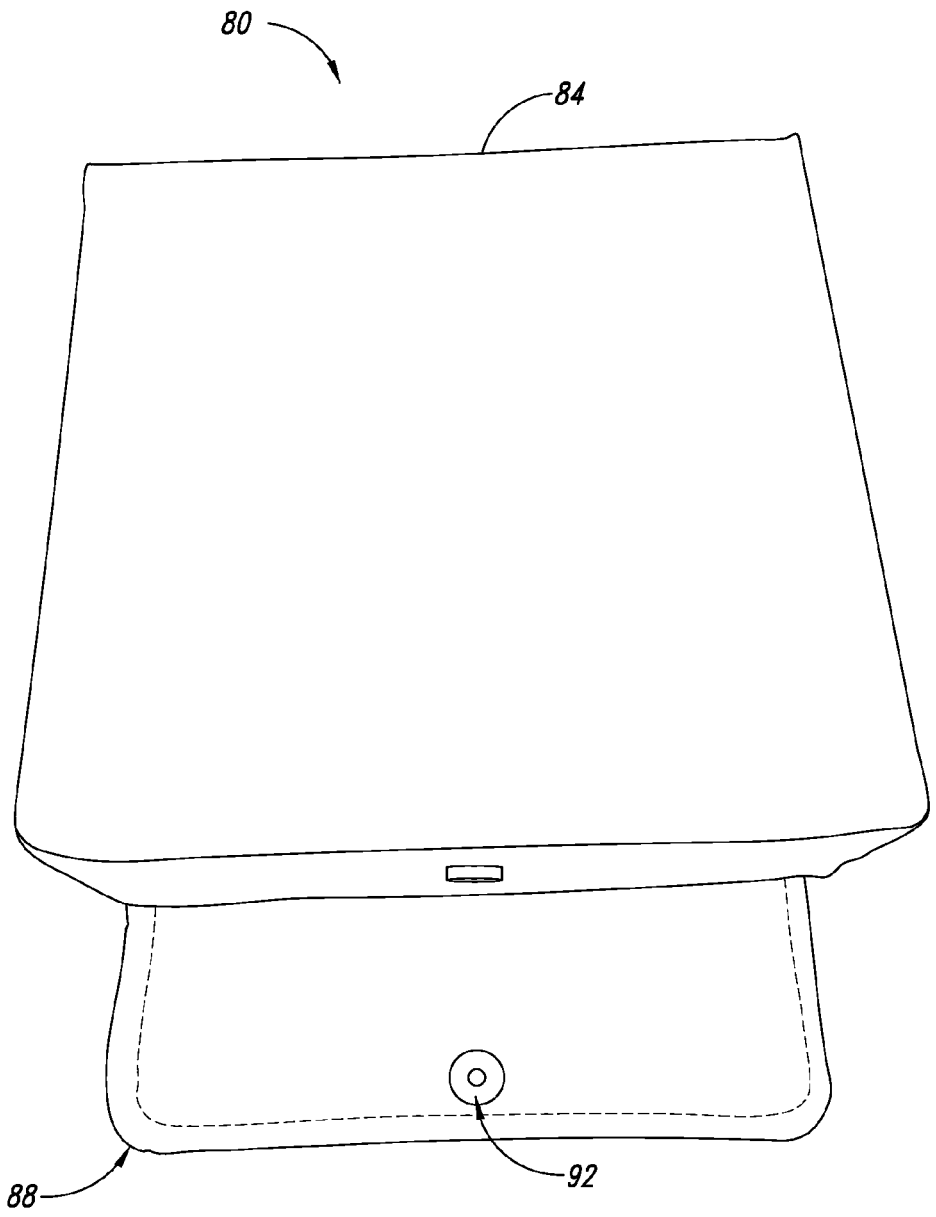
FIG. 8 is a bottom plan view of the lap desk of FIG. 7.
Figure 9:
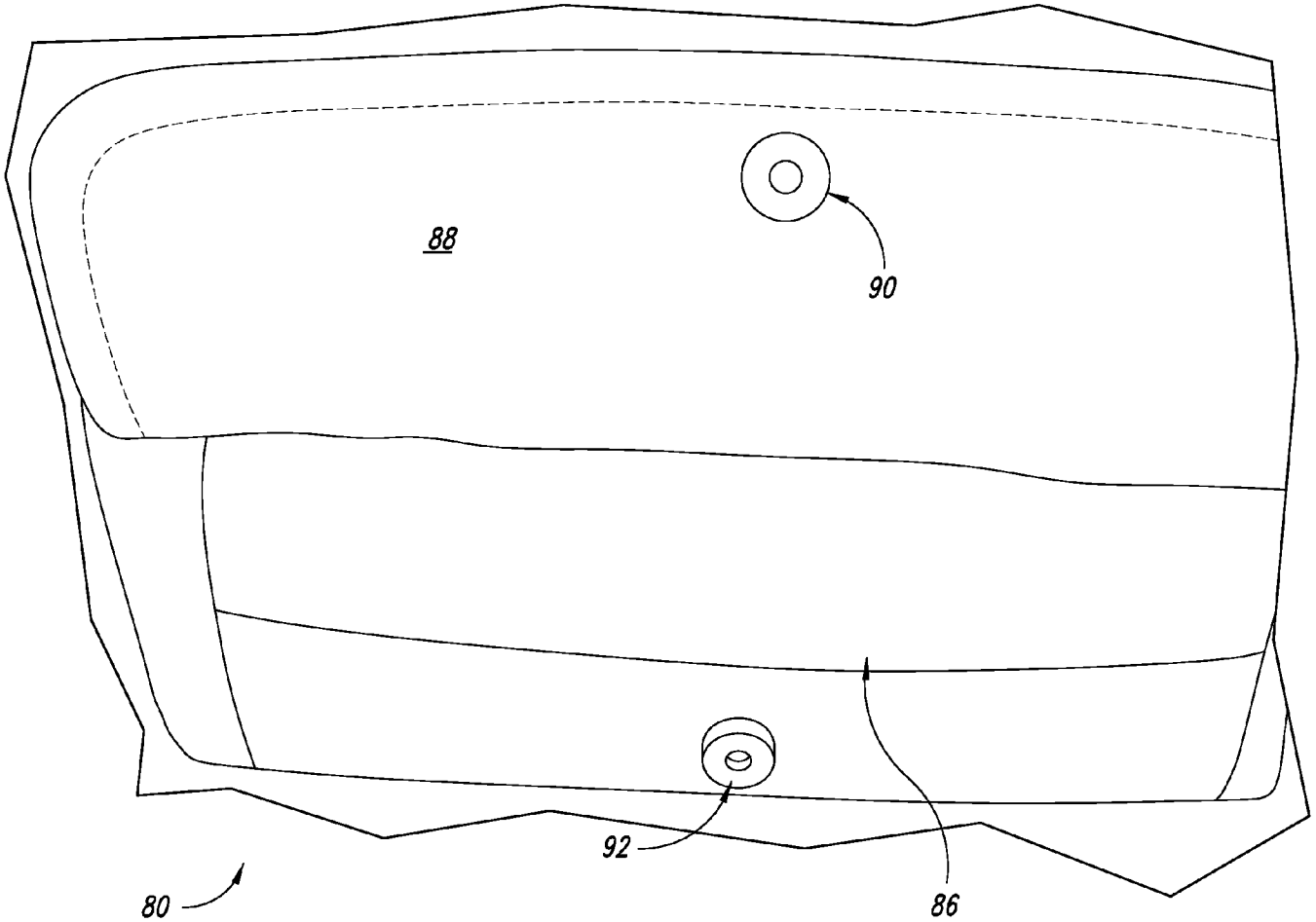
FIG. 9 is an isometric front view of the lap desk of FIG. 7 showing the flap in an opened configuration.

FIGS. 7-9 illustrate yet a further embodiment of a lap desk 80 formed in accordance with the present disclosure. In this embodiment, the lap desk 80 has the top 32 with forward lip 36 as previously described. The cushioned bottom 82 in this embodiment has a substantially smooth and planar yet cushioned bottom surface 84 with an internal storage compartment dimensioned as described above with respect to FIGS. 1-3, which is accessed by a rear opening 86 (shown more clearly in FIG. 9). A flap 88 attached to the bottom 82 immediately adjacent the top 32 extends downward to completely cover the opening 86. A magnetic snap 90 having a matching receptacle 92 is used to hold the flap 88 in a closed position. An optional handle 94 is shown attached at the attachment point of the flap 88 immediately adjacent the top 32.

Figure 10:
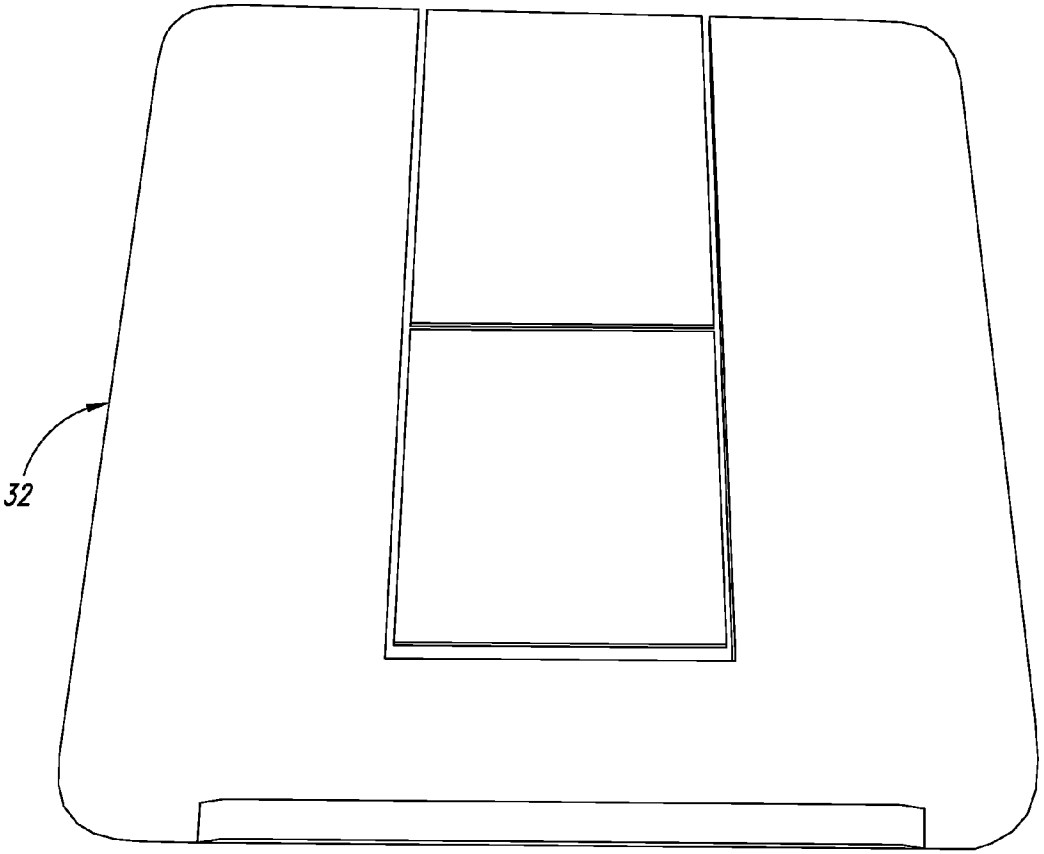
FIG. 10 is an isometric top front view of the plastic top of the lap desk of FIG. 7 in a stored configuration.
Figure 11:
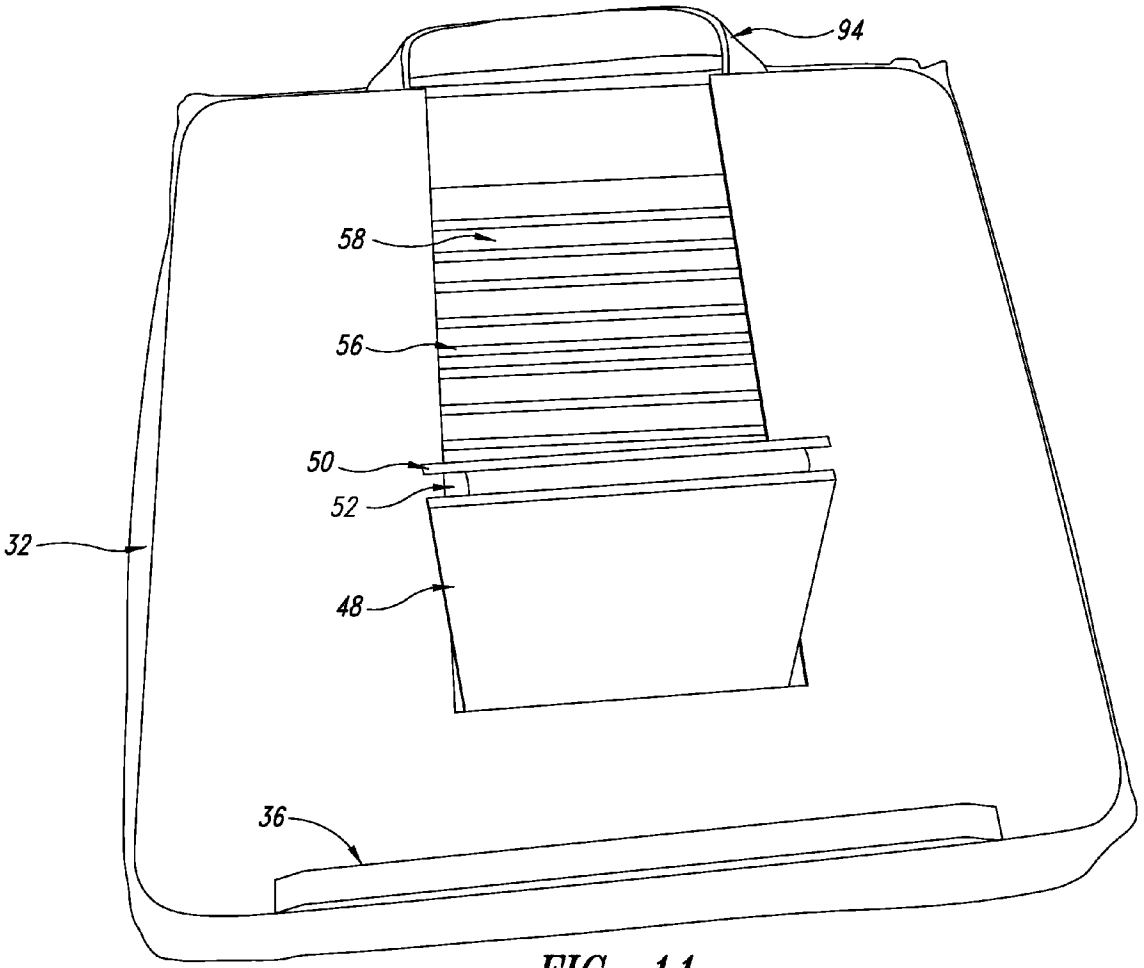
FIG. 11 is an isometric top front view of the top component of FIG. 10 in a deployed configuration.

FIG. 10 shows the components of the plastic top 32, and FIG. 11 shows the top 32 installed on the base 82 of the embodiment of the lap desk 80 shown and described in conjunction with FIGS. 7-9.

Figure 12:
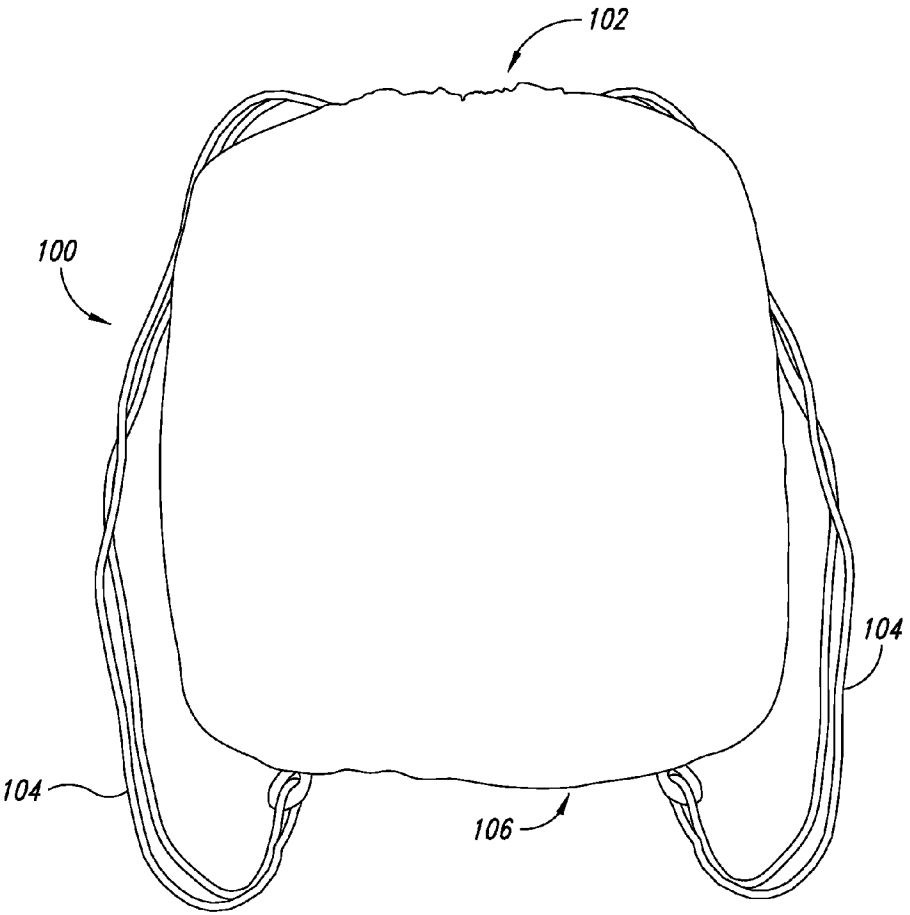
FIG. 12 is a side plan view of a lap desk storage container formed in accordance with still yet a further embodiment of the present disclosure having a rear storage pocket, rear internal storage compartment, and detachable cover.
Figure 13:
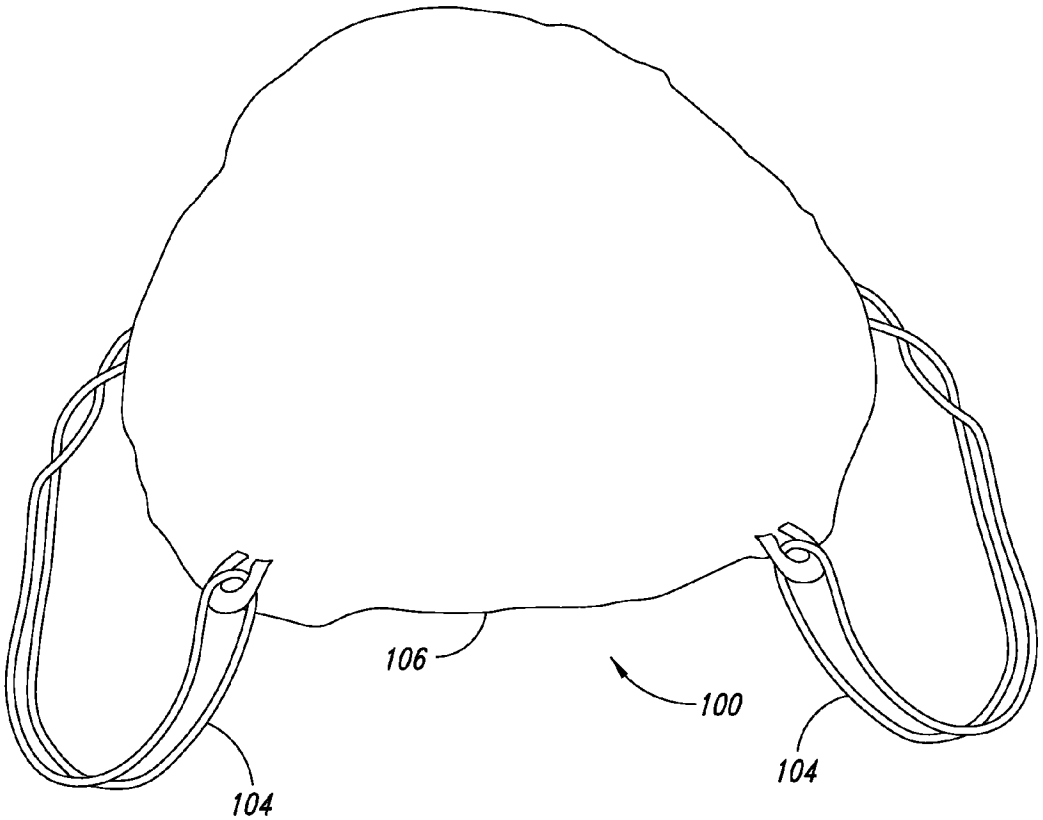
FIG. 13 is an isometric side bottom view of the storage container of FIG. 12.

FIGS. 12 and 13 show a removable cover 100 sized and shaped to receive the lap desk of any of the foregoing embodiments through a closable top 102. Straps 104 can be used to cinch down and close the top 102 as well as for carrying the lap desk. As shown in FIGS. 12 and 13, the straps 104 are attached to a bottom 106 of the carrying case 100 to form a pair of straps to be placed over a user's shoulders to enable a user to wear the carrying case 100 as a pack on their back (or front) as desired. Alternatively only one strap can be used to wear the pack over one shoulder.

Figure 14:
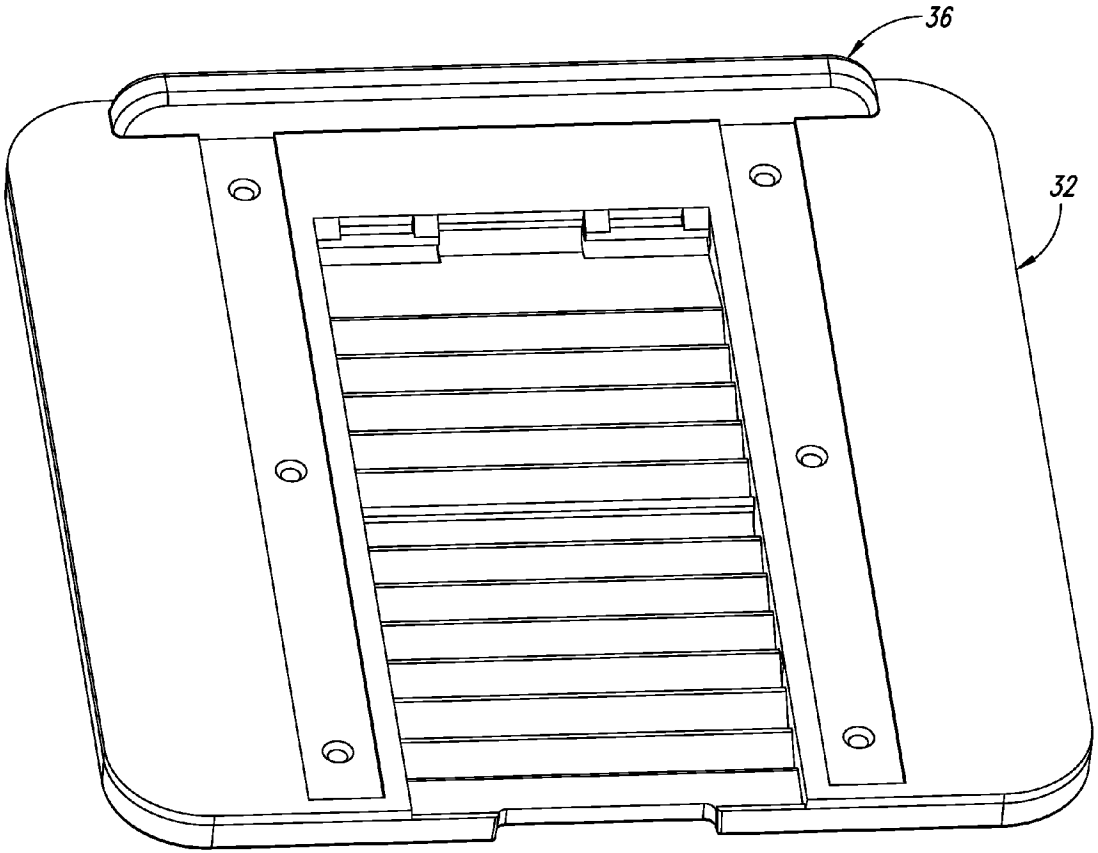
FIG. 14 illustrates a production version of an unassembled plastic top.
Figure 15:
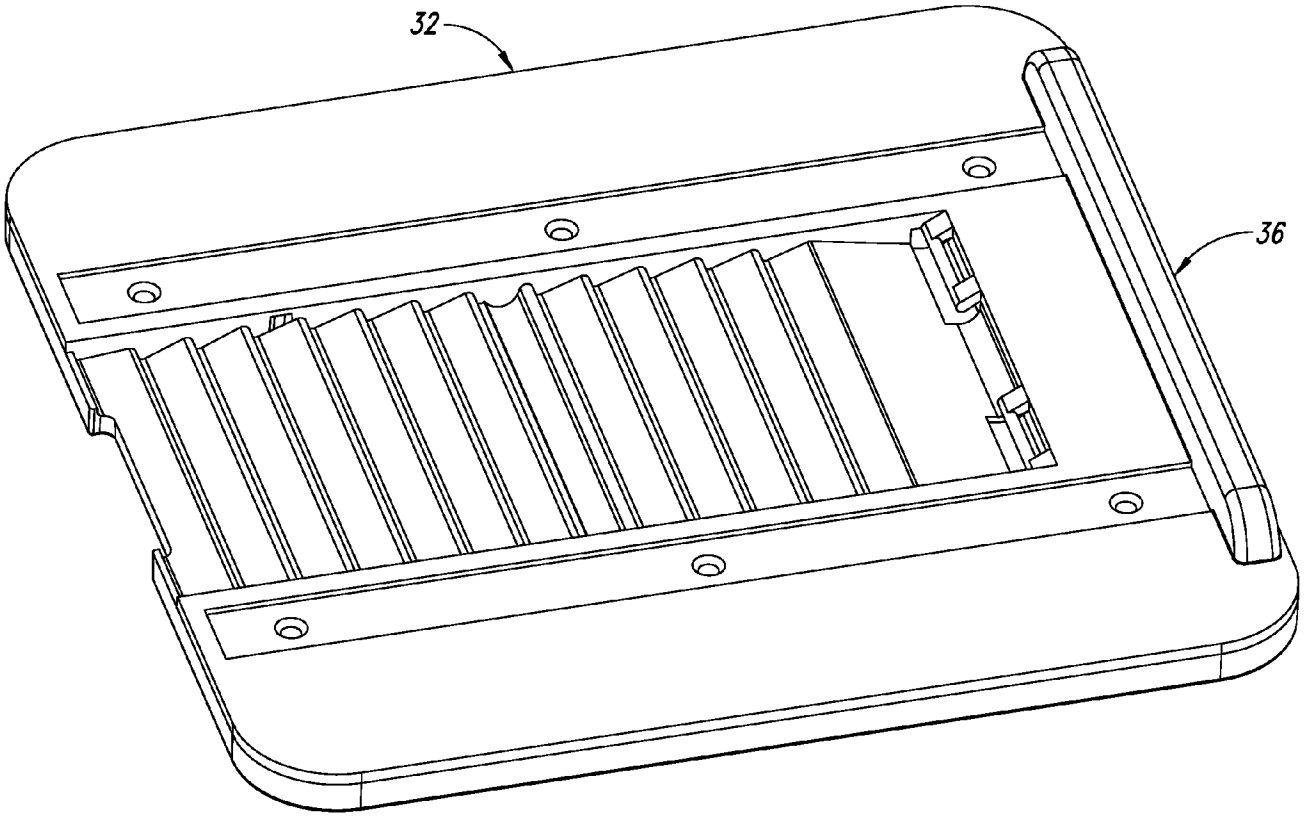
FIG. 15 illustrates the assembled plastic top of FIG. 14.
Figure 16:
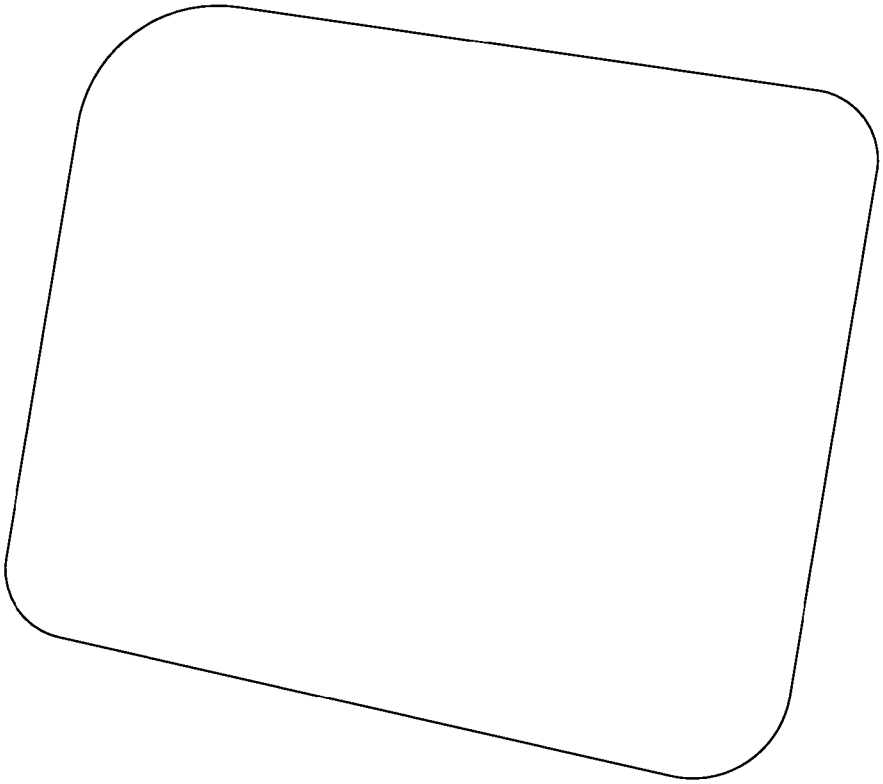
FIG. 16 illustrates a flat foam base.
Figure 17:
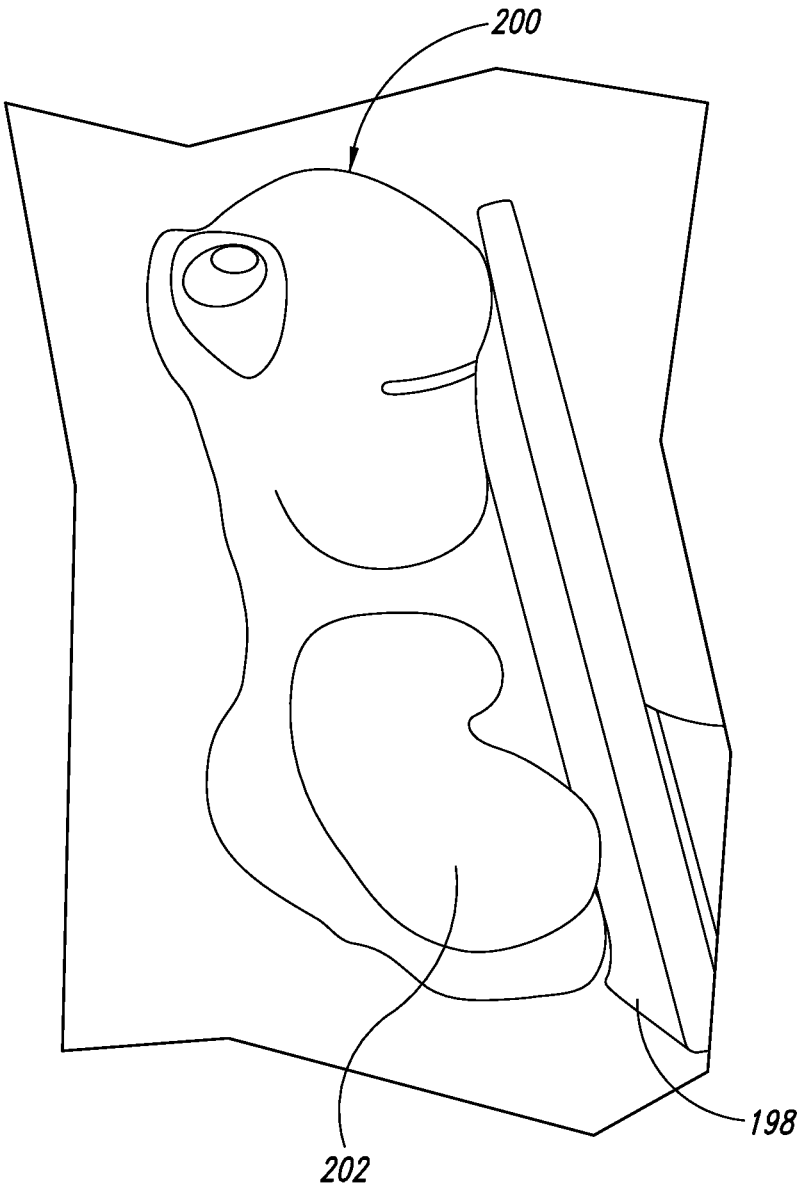
FIG. 17 illustrates a stuffed animal attached to the base.

FIGS. 14 and 15 illustrate production models of the top 32.

Set forth below is a list of materials and further construction details for one embodiment of the lap desk of the present disclosure.

Materials List:

Base of Prop:

High Density Foam

Batting

Plywood

Covering: Vinyl, Micro-suede, Rip-stop nylon, cotton, cording

Base Top:

Plywood Cut to desired size with square cut out to accommodate prop stops allowing for up to 20 different angle adjustments. Fabric overlay is stapled around the square hole to cover wood.

Base:

Foam is placed in base covering and then plywood is placed on top of foam

Covering is stapled to top of plywood to upholster base. A fabric strap can be attached to the back edge creating a handle.

Base Covering:

The base can also include a permanent or removable covering for the product. The covering can be velcroed, buttoned, sew, or otherwise attached to the base. The covering is typically made of rip-stop nylon with cotton cording attached for easier transport.

Prop Stops:

14 gauge wire, rubber tubing, (tubing is fed over wire and stapled into hole. The back of the hole is covered with heavy vinyl. Alternatively, a molded plastic one piece top that is contoured to create multiple strops can be used.

Prop Top:

Abs plastic is cut or molded to size, anywhere between 9 and 20 inches in width and 9 and 20 inches in length. The center can be cut out and cut in to two pieces or molded as such. All edges are sanded, smoothed, and finished. Living or snap hinges are applied with strong glue tape to the base of the cut out and to the two pieces to form the prop. A wooden or plastic lip is stapled and or glued to the lower edge of the plastic top to serve as a holder for the electronic device or book.

The Prop Top is glued or screwed to the upholstered base and clamped between two boards until dry.

Functionality:

As will be readily appreciated from the foregoing, the device of the present disclosure is designed to be a multi-angled lap desk. It is configured to hold books, games, electronic devices including but not limited to: tablet computers, laptops, electronic reading devices, media players, etc. The user can adjust the book, game, or device to the angle needed for the application at the time, (chair, bed, table, couch, lap, etc.) by moving the stand (angle adjuster) from zero degrees up to ninety degrees through the various six to twelve positions (depending on the model). Thus, the user can determine the best position needed for viewing, reading, gaming, or computing.

The base of the prop can be made flat or as a wedge angle. The front is anywhere from ½ inch to five inches thick, and the back of the base is anywhere from ½ inch to five inches thick.

The base can be plain or have a hidden storage compartment to hold an electronic device or book. The hidden storage compartment is made by cutting the high density foam from the back to the front in the center. Then when the fabric cover is being constructed a pocket is added to accommodate the hidden interior storage.

This hidden compartment can be covered with a pocket flap with closure, or it can be covered by an exterior pocket that holds the covering.

The base 198 can include an attached or detachable stuffed animal 200 as shown in the embodiment of FIG. 19. The stuffed animal 200 could rest vertically, horizontally, and flat or angled. The stuffed animal's arms 202 could be used to secure an object to the lap desk. Attachment can be by any known means, although hook-and-loop fasteners are preferred.

Figure 18:
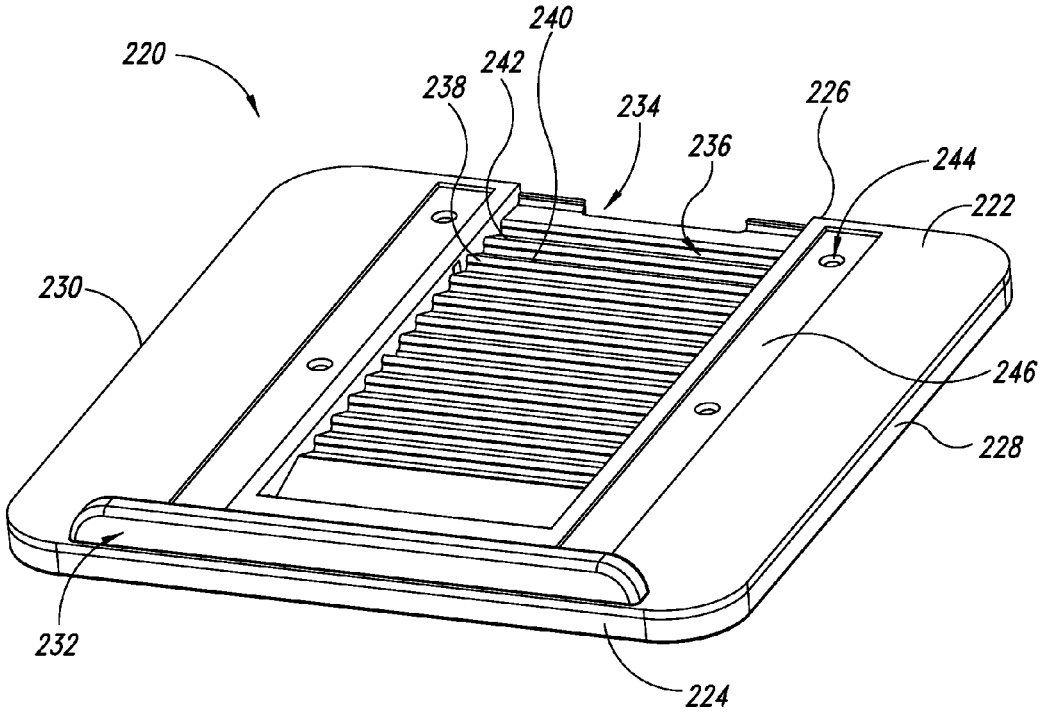

FIG. 18 illustrates a molded component that forms the basic top 220 of one embodiment of the lap desk in accordance with the present disclosure. Not shown are the articulated panels, fasteners, etc., that may be needed when combining the top 220 with a base. Thus, the top 220 has a planar working surface 222 with a proximal edge 224, a distal edge 226, and two side edges 228, 230. The proximal edge 224 has a lip 232 formed at or adjacent the edge 224 and which is structured to extend across a majority of the width of the proximal edge 224. The lip is structured to retain objects on the working surface 222 when the top 220 is at an angle such that objects would be prone to slide off the top 220 over the proximal edge 224.

A recess 234 is formed in the working surface 222 of the top 220 that extends from the distal edge 226 to a location adjacent to the lip 232. Molded within the recess 234 are transverse stops 236 that extend substantially across the entire recess 234. It is to be understood that the stops 236 need not extend across the entire recess 234, so long as they provide a sufficient bearing surface to hold the stand in a desired orientation.

As shown in FIG. 18, the stops are formed of a substantially vertical wall 238 and an angled top wall 240 that extends from the vertical wall 238 to an adjacent vertical wall 242. The size of the top wall 242 is determined by the number of stops 236 that are desired in order to provide a variety of angles at which the stand will be supported. In this embodiment twelve stops are illustrated. The height of the vertical walls 238, 242, etc., extends to a distance below the working surface 222 that leaves sufficient room for the stand to lay flat within the recess 234 to be coplanar with the working surface 222 of the top 220.

As shown in FIG. 18, a plurality of openings 244 are formed adjacent the recess 234 and extend through the top 220 for accommodating fasteners (not shown) used to attach the top 220 to a corresponding base (not shown in this figure). The openings 244 are formed on each side of the recess 234, preferably within longitudinal recessed strips 246 that can then be covered to obscure viewing of the fasteners within the openings 244 and to provide a smooth working surface.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device to support objects on a user's lap, comprising:

a base having a cushioned bottom surface;

an articulated bi-fold support stand configured to support objects at a selected angle, the stand having first and second panels, each panel having a planar top surface; and a top having a planar working surface that lies in a plane and is mounted to the base, the top having a recess area in the working surface and a plurality of stops formed entirely across the recess, each stop having a first wall substantially orthogonal to the working surface and an angled wall that extends from a top of the first wall to a bottom of an adjacent first wall of an adjacent stop, each first wall of each stop having a height that extends to a distance below the working surface that leaves sufficient room for the support stand to lay flat within the recess with the respective planar top surfaces of the first and second panels in a coplanar relationship with each other and to be completely flat and entirely within the plane of the planar working surface of the top, wherein the articulated bi-fold support stand is attached to the top and configured to support objects at a selected angle relative to the planar working surface of the top, the first and second panels hingedly attached at respective first edges, the second panel having a second edge, and wherein the plurality of stops formed in the recess are structured to receive the second edge of the second panel and hold the stand at the selected angle.

2. The device of claim 1, comprising an expandable storage compartment formed in the base.

3. The device of claim 2, comprising an opening to the storage compartment formed on one side wall of the base and a pouch formed on another side wall of the base.

4. The device of claim 1, comprising a lip at or adjacent to a proximal edge of the top, the lip sized and shaped to retain objects on the top when the objects are supported by the stand or when the top is at an orientation that objects could slide off the top at the proximal edge of the top.

5. The device of claim 3, comprising a cover sized and shaped to enclose the device, the cover being attached to the base and structured to be stored in the pouch.

6. The device of claim 5, wherein the cover includes at least one strap structured to be used as a handle or shoulder strap.

7. The device of claim 1, comprising:

a stuffed animal structured to attach to the base.

8. A portable lap desk, comprising:

a base formed of cushioned material and having an internal storage compartment formed in the cushioned material that is accessible via at least one opening in the cushioned material;

a rigid top attached to the base, the top having a planar working surface that lies in a plane and a recess formed in the working surface that includes a plurality of stops formed entirely across the recess the plurality of stops having a height that is lower than the planar working surface of the top to define a storage space; and a bi-fold stand attached by a hinge to the top and configured to cooperate with the plurality of stops to be deployed at a selected angle relative to the working surface, the bi-fold stand including first and second panels that each have a planar top surface, the first and second panels sized and shaped to be received in the storage space in the recess with the top surfaces of the first and second panels in a coplanar relationship with each other and to be completely flat and entirely within the plane of the planar working surface of the top, wherein the first panel has a first edge attached to the top with a hinge for pivotal movement, and an opposing second edge attached with a hinge attached to a first edge of the second panel and configured to enable pivotal movement of the second panel relative to the first panel, the second panel having a second edge configured to engage one stop of the plurality of stops.

9. The portable lap desk of claim 8, comprising a lip at or adjacent to a proximal edge of the top, the lip sized and shaped to retain objects on the working surface of the top when the objects are supported by the stand or when the working surface of the top is at an orientation that objects could slide off the working surface towards the proximal edge of the top.

10. The portable lap desk of claim 8, comprising a cover sized and shaped to enclose the device, the cover formed of flexible fabric and attached to the base.

11. The portable lap desk of claim 10, further comprising a pouch formed on the base and sized and shaped to receive the cover, and further wherein the cover includes at least one strap structured to be used as a handle or shoulder strap.

* * * * *